US006934599B2

(12) United States Patent
Kaymer et al.

(10) Patent No.: US 6,934,599 B2
(45) Date of Patent: Aug. 23, 2005

(54) PROVIDING CHARACTER DATA FOR USE BY AN EMBROIDERY MACHINE

(75) Inventors: Andrew Bennett Kaymer, Essex (GB); Andrew Wyatt, London (GB); Anders Pehrsson, Jonropin (SE)

(73) Assignee: VSM Group AB (SE)

( * ) Notice: Subject to any disclaimer, the term of this patent is extended or adjusted under 35 U.S.C. 154(b) by 52 days.

(21) Appl. No.: 10/419,056

(22) Filed: Apr. 18, 2003

(65) Prior Publication Data

US 2003/0212470 A1 Nov. 13, 2003

(30) Foreign Application Priority Data

Apr. 22, 2002 (GB) ..... 0209171

(51) Int. Cl.[7] ..... D05C 5/02
(52) U.S. Cl. ..... 700/138; 112/475.19
(58) Field of Search ..... 700/130, 136, 700/138; 112/78, 475.18, 475.19

(56) References Cited

U.S. PATENT DOCUMENTS 4,388,883 A 6/1983 Hirota et al. ..... 112/121.12
4,557,207 A 12/1985 Turner et al. ..... 112/266.1
4,622,907 A 11/1986 Kimura ..... 112/121.12
4,919,062 A 4/1990 Yokoe et al. ..... 112/121.12
5,048,439 A 9/1991 Tschopp et al. ..... 112/458
5,255,198 A 10/1993 Yokoe et al. ..... 364/470
5,558,032 A * 9/1996 Muto et al. ..... 112/102.5

FOREIGN PATENT DOCUMENTS

| | | |
|---|---|---|
| GB | 2 317 027 | 3/1998 |
| GB | 0209791.8 | 8/2002 |
| JP | 9-256258 | 9/1997 |

* cited by examiner

*Primary Examiner*—John J. Calvert
*Assistant Examiner*—Brian Kauffman
(74) *Attorney, Agent, or Firm*—Theodore M. Magee; Westman, Champlin & Kelly, P.A.

(57) ABSTRACT

The disclosure provides an embroidery data group for each character of a predetermined font, the consequent set of embroidery data groups being for use by an embroidery machine for inclusion in an embroidery design. The embroidery data groups are provided in such a way that each data group is individually selectable by the embroidery machine.

25 Claims, 10 Drawing Sheets

PROVIDING CHARACTER DATA FOR USE BY AN EMBROIDERY MACHINE

BACKGROUND OF THE INVENTION

The invention relates to the provision of character data for use by an embroidery machine, and in particular, but not exclusively, to the conversion of font character data to embroidery machine readable data for selectable inclusion by an embroidery machine in an embroidery design.

Embroidery designs, when created using computer software, are typically defined by many small geometric or enclosed curvilinear areas. Each geometric area is defined by a single embroidery data object comprising information such as the object outline, stitch type, colour and so on.

For example, a rectangular area of satin stitches might be defined in an embroidery object by the four control points that make up its four corners, while a circular area of fill stitches might be defined by two control points typically the centre of the circle and a point indicating the radius. A more complex shape would normally be defined by many control points, spaced at intervals along the boundary of the shape. These control points may subsequently be used to generate a continuous spline or other curve approximating the original shape.

Having generated an object-based design description, the embroidery objects are converted into a vector-based stitch design which is then used to control an embroidery machine. Such stitch designs contain a sequence of individual stitch instructions to control the embroidery machine to move an embroidery needle in a specified manner prior to performing the next needle insertion. Apart from such vector data, stitch instructions may also include data instructing the embroidery machine to form a thread colour change, a jump stitch or a trim.

It is frequently desirable to incorporate letters, numbers and similar characters into embroidery designs. To this end, it is known to provide embroidery design software for use on a personal computer which includes font data for incorporation into an embroidery object-based description of a design. The object-based description is usually converted by the embroidery design software into a stitch instruction description of the design for subsequent downloading to and stitching out by an embroidery machine. Alternatively, the object-based description may be converted to a stitch instruction description after downloading to a embroidery machine having a sufficiently powerful computer processor to handle the complex conversion process.

The font data accessible to the embroidery design software may be provided as conventional TRUETYPE® brand font, OPENTYPE® brand font, POSTSCRIPT® brand font or other known kinds of computer font which are converted to embroidery objects or stitch instructions by the design software, or which are already available to the software in the form of embroidery objects or stitch instructions. In either case, known embroidery design software incorporates the required character data into the overall design to be stitched before export to the embroidery machine.

Recently, embroidery machines have been manufactured with increasingly sophisticated embroidery design software on board, as the cost of incorporating the required electronics into such machines has fallen. It is known, for example, to provide an embroidery machine having a non-volatile memory containing stitch instruction data relating to all the characters of a particular font, at a particular or several particular scalings.

It is also known to provide such stitch instruction data on a floppy disk which can be read by an embroidery machine, thereby enabling a machine user to gain access to a wide variety of stitchable fonts. To ensure that the characters are as neat and tidy as possible when stitched out, the stitch instruction data is defined by a professional designer working on one scaling of each character of each font at a time. The stitch instructions, once defined in this way, are not generally scalable to define characters of different sizes as this would lead to problems such as over filling, under filling, fabric distortion and inappropriate embroidery thickness on stitching out.

As embroidery machines carry computer processors of increasing power, it would be desirable to provide users of such machines with more flexible ways of incorporating font characters into their embroidery designs. The present invention seeks to address this need, and to overcome problems and disadvantages of the related prior art.

SUMMARY OF THE INVENTION

Accordingly, the invention provides a method of operating a computer system to provide character data for use by an embroidery machine, comprising the steps of:

inputting font character data defining the characters of a predetermined font;

generating, in a predetermined embroidery data format, a respective embroidery data group from the font character data of each respective font character; and outputting said embroidery data groups in such a way that each embroidery data group is individually selectable by an embroidery machine for inclusion in an embroidery design.

The computer system used may typically comprise a suitably programmed personal computer. The font character data may therefore already be available on the personal computer as part of the operating system, or may be obtained by purchase or by free distribution, especially over the Internet.

By outputting the embroidery data groups in such a way that each group is individually selectable by an embroidery machine adapted to read the predetermined format, users of an embroidery machine can use a wide variety of fonts in designs constructed on the embroidery machine itself.

Preferably, the step of generating respective embroidery data groups comprises the step of generating a respective embroidery object group from the font character data of each respective font character, each object group comprising one or more embroidery objects, and wherein said output embroidery data groups comprise said embroidery object groups.

Alternatively, the step of generating respective embroidery data groups comprises the steps of:

generating a respective embroidery object group from the font character data of each respective font character, each object group comprising one or more embroidery objects; and converting said respective embroidery object groups to a corresponding respective stitch instruction groups, and wherein said output embroidery data groups comprise said stitch instruction groups.

In this alternative, it is preferable to scale the objects of the embroidery object groups as desired before, or while generating the stitch instructions, as the output stitch instruction data cannot be scaled very effectively while producing a satisfactory stitch out pattern.

Preferably, the font is a scalable font, and typically will define the outline or outlines of each character of the font. Suitable fonts of this type include TRUETYPE® brand font, OPENTYPE® brand font, and POSTSCRIPT® brand font.

Preferably, all or substantially all of the characters in any predetermined font are output as said embroidery data groups, so as to provide the user of the data with the maximum creative flexibility.

Preferably, the process of generating the embroidery data groups from the font character data is carried out automatically, by appropriate conversion software. However, a moderate amount of human intervention could be allowed, if desired to improve the output embroidery data groups.

Preferably, the step of generating a selected one of said embroidery data groups from the corresponding font character data comprises the steps of:

analysing the font character data to identify one or more outline contours of the corresponding font character;

associating the contours into one or more contour groupings, each contour grouping defining an outline of at least a part of the corresponding font character;

constructing one or more cut lines across one or more of the contour groupings;

dividing the contour groupings along the cut lines to yield a larger number of contour groupings;

and defining a plurality of embroidery objects, each embroidery object being derived from a respective one of said larger number of contour groupings. In this way, simpler contour groupings more appropriate for the construction of embroidery objects suitable for neat stitching out are formed.

Preferably, the step of selecting one or more cut lines comprises the steps of:

identifying changes of direction of the outline contours, the changes of direction having predetermined characteristics; and constructing one or more cut lines proximate to the identified changes of direction. Preferably also, the step of constructing the one or more cut lines comprises the steps of:

generating a skeleton corresponding to the font character;

identifying one or more nodes of the skeleton; and constructing one or more cut lines proximate to the identified nodes. An iterative identification of cut lines based on successively simpler or geometrically smaller contour groups, each of which is derived from a larger contour group divided using cut lines, may be used.

The embroidery data groups may be written onto one or more removable machine readable media, such as floppy disks, CDROMS or solid state memory devices. Because the output embroidery data is intended for use on an embroidery machine a medium should be used that can be read by that machine. Alternatively, the output embroidery data could be transferred by a telecommunications link, a serial, parallel or other data cable or other data link to the embroidery machine to be stored therein, preferably in a non-volatile memory.

Preferably, the method further comprises the steps of: inputting, into an embroidery machine, one or more of said embroidery data groups corresponding to one or more of said characters; and incorporating, in said embroidery machine, said input embroidery data groups into an embroidery design. The method preferably further comprises the step of storing said embroidery design in a memory of said embroidery machine, and the step of operating the embroidery machine to stitch out at least a part of said embroidery design.

The invention also provides a method of operating a computer system to produce an embroidery data group comprising an object-based description of a font character, from font character data describing the font character, the method comprising the steps of:

analysing the font character data to identify one or more outline contours of the font character;

associating the outline contours into one or more contour groupings, each contour grouping defining the outline of at least a part of the font character;

selecting one or more cut lines across one or more of the contour groupings;

dividing the contour groupings along the cut lines to yield a larger number of contour groupings; and defining a plurality of embroidery objects, each embroidery object being derived from a respective one of said larger number of contour groupings.

The invention also provides a computer readable medium comprising computer program instructions arranged, when executed on a computer, to carry out the steps described above leading to and including output of the embroidery data groups onto a suitable medium or via a suitable data link, and a computer system adapted to carry out these steps.

The invention also provides a removable machine readable medium comprising a respective embroidery object group for each respective character of a predetermined font, said embroidery object groups being arranged so as to be individually selectable by an embroidery machine for inclusion in an embroidery design.

BRIEF DESCRIPTION OF THE DRAWINGS

FIGS. 3*a* and 3*b* show examples of contours which are not descendent, while

DETAILED DESCRIPTION OF ILLUSTRATIVE EMBODMENTS

Figure 1:
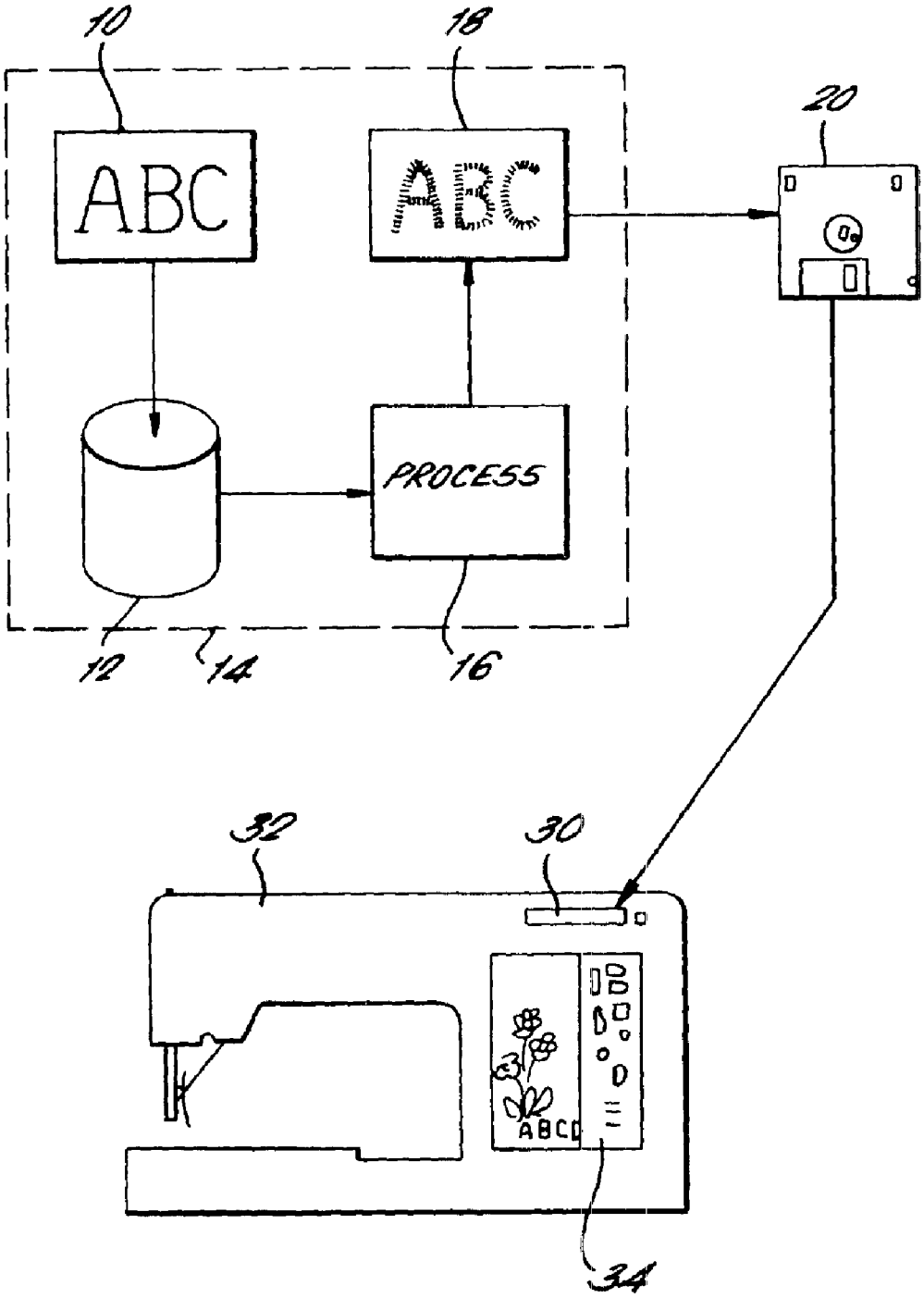
FIG. 1 illustrates application of the invention to provide character data for use by an embroidery machine.

FIG. 1 illustrates schematically use of the invention to provide character data in an embroidery format, for use by an embroidery machine. A font file 10, containing font character data for use by a computer to display or print characters of the font, is stored, typically on a hard disk 12, within a personal computer 14. The personal computer 14 has conventional input, output, memory, processor and storage capabilities. A conversion process 16 executing on the computer 14 accepts the font file 10 as input and outputs a corresponding embroidery data file 18, which may subsequently be written to a suitable removable machine readable medium such as a floppy disk 20. The embroidery data file contains a respective embroidery data group corresponding to each respective character of the font.

The floppy disk 20 is loaded into a disk drive 30 of an embroidery machine 32 having a user interface 34 which enables at least simple embroidery designs to be constructed on the embroidery machine and stored therein in volatile or non-volatile memory. The embroidery machine provides software facilities which enable the user to incorporate chosen characters of the font file 10, stored in an embroidery format on the floppy disk 20, into an embroidery design for subsequent stitching out by the embroidery machine 32.

The font file 10 may contain vectorized font data, or other kinds of font data. Preferably the font data defines the outlines of each font character. The font file 10 may form part of a pre-loaded operating system on the personal computer 14, or may be especially loaded for the purposes described herein. The conversion process 16, typically provided as a software application, is adapted to accept the font file 10, and carry out automatic processing to convert the group of data relating to each font character in the font to a corresponding group of embroidery data suitable for input to the embroidery machine 32. Suitable formats for the groups of embroidery data include embroidery object data and embroidery stitch instruction data.

A process by which font character data, and in particular vectorized data may be converted to embroidery data will now be described, beginning with a glossary of terminology to be used.

Glossary

"font": A series of characters, usually but not necessarily including a complete alphabet, (lower and upper case), all punctuation characters, the numbers 0 to 9, usually bearing common design features (e.g. absence or presence of serifs) . Some fonts include icons and pictures either as well as, or instead of, letters and numbers.

"stitch data": An embroidery design described stitch by stitch by two-dimensional vectors. Optionally, each stitch instruction may also include additional data for instructing the embroidery machine, e.g. a jump stitch, colour change, or trim.

"embroidery object": Information describing geometric forms such as columns, lines, complex polygons bounded by lines or curves, etc. in conjunction with instructions for producing a stitch file from these geometric forms. The additional instructions may include stitch densities, fill patterns, thread colours, and compensation factors.

"embroidery object control points": Points used to define the lines, rectangles and curves that make up stitch object data.

"TRUETYPE® font": TRUETYPE® is a Trademark of Apple Computer Incorporated for a type of vectorized font in which the characters are made up of curved and straight sections, where curved sections are made up of three control points that define a quadratic Bèzier curve (see contour section definition for more details), and straight sections are made up of two control points that define the start and the end of the line segment.

TRUETYPE® brand fonts are also types of outline fonts—the data contained inside TRUETYPE® brand fonts describes the outlines that define the different areas that make up each TrueType font character.

"contour section": Contours and contour sections are defined in different ways in different font types. A contour section of a TrueType font is defined by two or three points. The contour section provides part of the shape that makes up a font character. A contour section is either straight (which requires two reference points to define it) or curved. Curved contour sections are quadratic Bèzier curves; they are defined by three reference points, and the locus of the curve is described using the mathematical formula below:

$$P(t)=A(1-t)^2+2B(1-t)t+C\,t^2$$

where the parameter t describes the position along the curve and A, B and C are the three vector reference points that define the curve.

Figure 2:
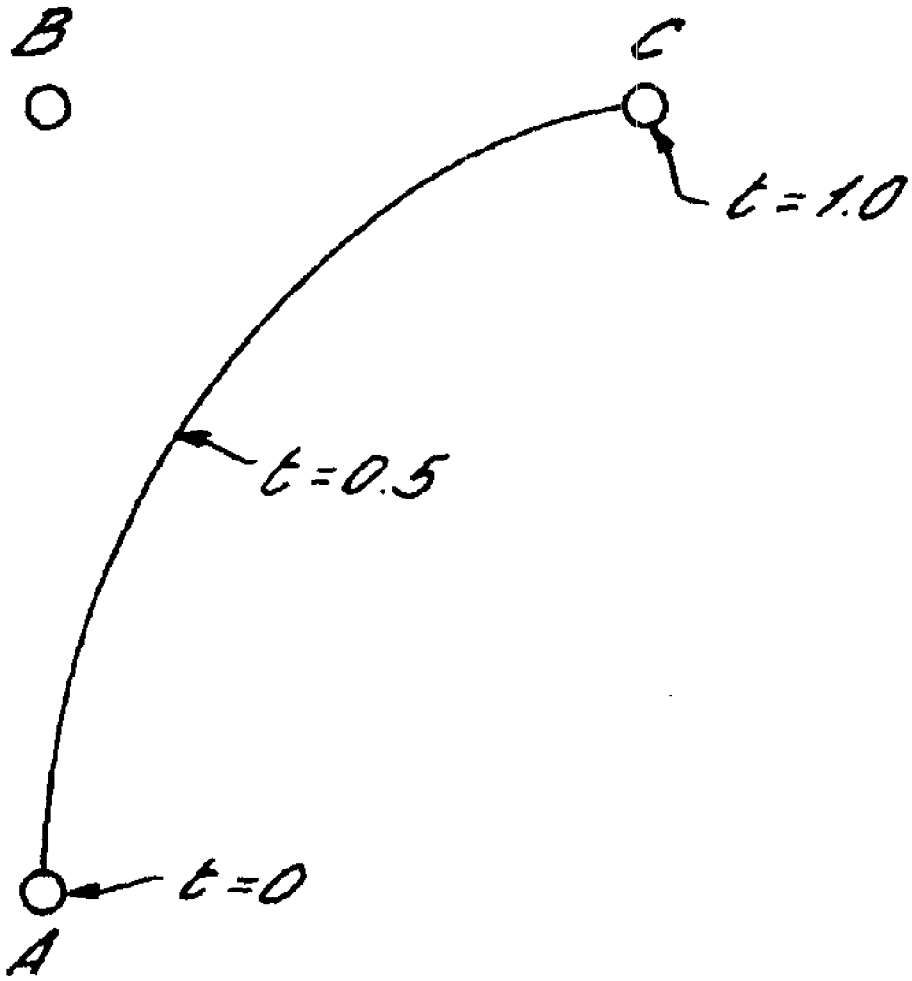
FIG. 2 illustrates features of a contour section of a vectorized font.

A contour section is illustrated in FIG. 2, in which three particular values of parameter t are pointed out. It will be seen that:

t=0 refers to the start of the curve, at point A, t=0.5 refers to the point parametrically halfway along the curve from A to C, and t=1 refers to the end of the curve, at point C.

"contouro": A contour is a series of joined contour sections that define an area of a font character.

"descendant contour": The term descendant contour is used to describe whether one contour is completely contained inside another contour. A contour X is said to be a descendant of a contour Y if and only if contour X does not intersect contour Y and a point in contour X can be found that lies within contour Y.

Figure 3A:
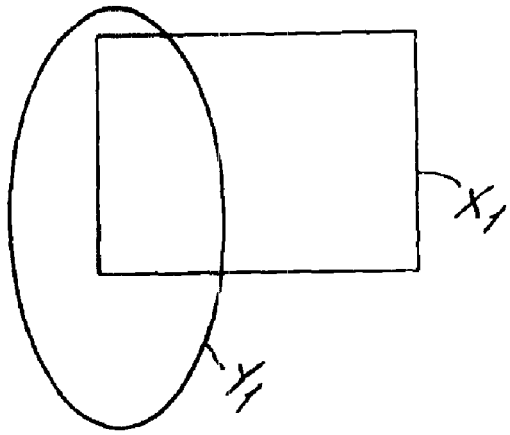
Figure 3B:
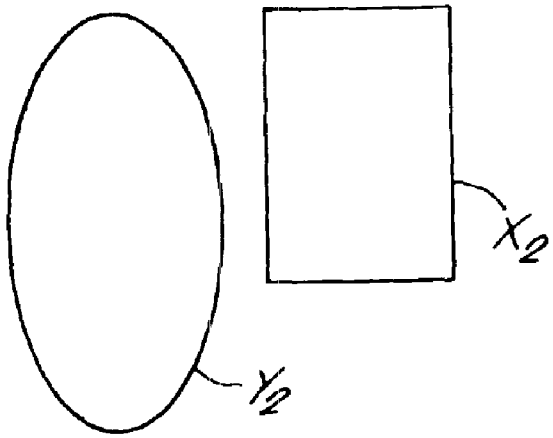
Figure 3C:
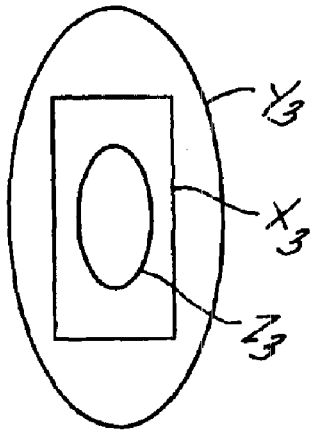
FIG. 3*c* shows contours which are descendent.

FIGS. 3*a*, 3*b* and 3*c* shows cases when contours are and are not descendant.

In FIG. 3*c*, $Z_3$ and $X_3$ are descendants of $Y_3$, and also $Z_3$ is a descendant of $X_3$. In FIG. 3*b*, $X_2$ is not a descendant of $Y_2$ since no point along $X_2$=s edge lies inside $Y_2$, and vice-versa. In FIG. 3*a*, $X_1$ is not a descendant of $Y_1$ (and $Y_1$ is not a descendant of $X_1$) since contour $X_1$ intersects $Y_1$.

"child contour": A contour x is said to be a child contour of contour y if and only if both:

(1) x is a descendant contour of y; and (2) there does not exist a contour z within y such that z is a descendant of y and x is a descendant of z.

In FIG. 3*c*, it will be seen that $X_3$ is a child contour of $Y_3$, $Z_3$ is a child contour of $X_3$, but $Z_3$ is not a child contour of $Y_3$.

"contour grouping": A contour grouping is a set of one or more contours that describe the fillable area of part or the whole of a font character. One contour is denoted as the parent contour and all other contours (if any) are child contours.

"wide corner / utility corner": A point on a contour of a contour grouping is said to be a wide corner if the internal angle formed at the given point is greater than 200 degrees.

A point on a contour of a contour grouping is said to be a utility corner if the internal angle formed at the given point is less than 200 degrees, greater than 95 degrees and not in the range 170 to 190 degrees.

"skeleton of contour grouping": A skeleton of a contour grouping is a bitmap image created by a bitmap thinning process applied to a bitmap image produced by filling the area defined by the parent and child contours that make up the contour grouping. The bitmap thinning process used here is Rosenfeld=s parallel thinning algorithm (AGraphics Gems IV@ by Paul S. Heckbert, p. 465–473), but other thinning or skeletonisation algorithms could be used.

"skeleton node": A skeleton node is a point of a skeleton which is connected (horizontally, vertically or diagonally) to 3 or more other points in the skeleton.

"skeleton end": A skeleton end is a point in a skeleton of a contour grouping which is connected (horizontally, vertically or diagonally) to only 1 other point in the skeleton.

"skeleton path": A skeleton path is a series of skeleton points joining a skeleton node to another skeleton node, a skeleton node to skeleton end, or a skeleton end to another skeleton end.

Content of Conversion Process

The conversion process described below provides for the automatic conversion of a vectorized font or similar font descriptor into a format suitable to be imported into an embroidery machine for subsequent use in designs created using software built into the embroidery machine. A complete vector based font, or subset of such a font, is selected for conversion into a format which will permit an embroidery machine to import and manipulate the font character by character. The converted font is saved either to an embroidery-machine readable medium such as a 3.5 inch diskette, or directly into the RAM (or other programmable memory) of an embroidery machine. The converted font may be saved either as stitch data or as embroidery objects. The software in the embroidery machine may then load the converted font into RAM (unless already placed there directly), and permit a user to utilise the characters of the font by adding them to an existing design, or creating a new design from one or more of the font characters, placing them anywhere in the area of the design. If the converted font consists of embroidery objects then the elements of the font utilised in a design must be converted to stitch data within the embroidery machine, ready for embroidering. The designs created using the font characters may then be embroidered.

The format of the converted font may be either stitch data or embroidery objects. If the format of the converted font is embroidery objects, other processes may be applied to the data in the embroidery machine including but not limited too:

1) Creating stitch data from the embroidery objects
2) Embroidering using this stitch data
3) Low level manipulation of the stitch objects by a user, by adjusting their embroidery object control points
4) Transforming the stitch objects by resizing, shearing, mirroring, rotating, or any combination of these transformations, either individually or in groups constituting characters or groups of characters, including entire fonts.

The stitch data or embroidery objects created by the conversion process may create stitches of the following types, or embroidery objects for the creation of stitches of the following types: satin, fill, satin outline, and running stitch outline. This document principally describes a method for creating stitch data or embroidery objects of the satin type.

The conversion process begins with the extraction of contours from the font data, and the grouping of these contours into one or more contour groupings each representing a discrete fillable part of a font character. The contour groupings are then simplified to divide each part of the character into simpler sub-parts. These sub-parts are then ordered and traversed to produce a group of suitably linked embroidery objects, which are optionally converted further into embroidery stitch instructions.

Font Contour Extraction and Contour Grouping

The first part of converting of each vectorized font character to an embroidery format involves extraction of font data from the file containing the vectorized font character being processed. Data is extracted from the font file in the form of straights and curves (contour sections) that make up each contour that define the character.

The contours are then processed to form a number of contour groupings each relating to a discrete fillable area of the font character. The method to group the contours of a particular font character is as follows:

(1) For each contour, determine its descendant contours, and subsequently its child contours.

(2) If there are any contours which are not part of a contour grouping (these contours are referred to as "unassociated"), find the unassociated contour with the most descendant contours, or choose an arbitrary contour from the group if there exists more than one contour with the same and most number of descendant contours. The chosen contour becomes the parent contour of a new contour grouping; any child contours of the chosen contour become child contours of this new contour grouping.

(3) Repeat step 2 until all contours are part of a contour grouping.

Simplification of Contour Groupings

The next stage of the process is to simplify each of the contour groupings. The result of simplifying each contour grouping will be a collection of smaller, simpler contour groupings, if simplification has been possible.

Figure 4A:
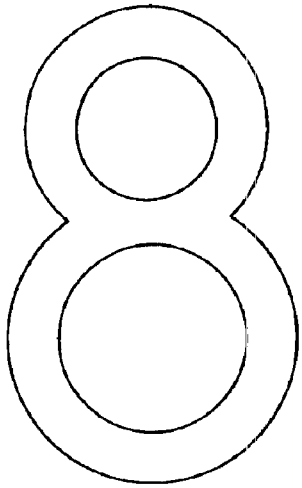
FIG. 4*a* shows a contour grouping defining a font character. The contour grouping is shown with a number of cut lines in FIG. 4*b,* and divided into a plurality of smaller contour groupings by the cut lines in FIG. 4*c;*

In order to simplify a contour grouping, the process looks for cut lines that cut across the fillable area defined by the contour grouping, each cut line being defined by two end points, each of which lies on a contour of the contour grouping. FIGS. 4*a,* 4*b* and 4*c* show an example of a set of cut lines.

Figure 4B:
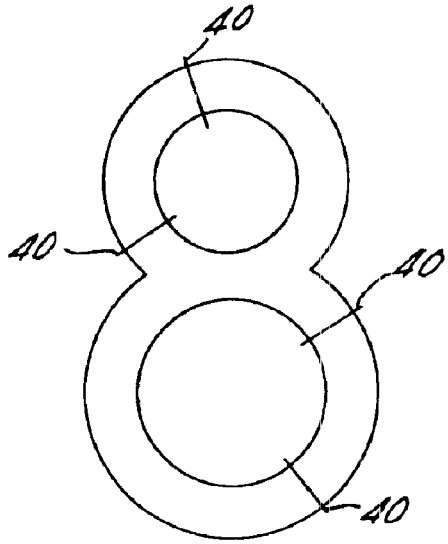
Figure 4C:
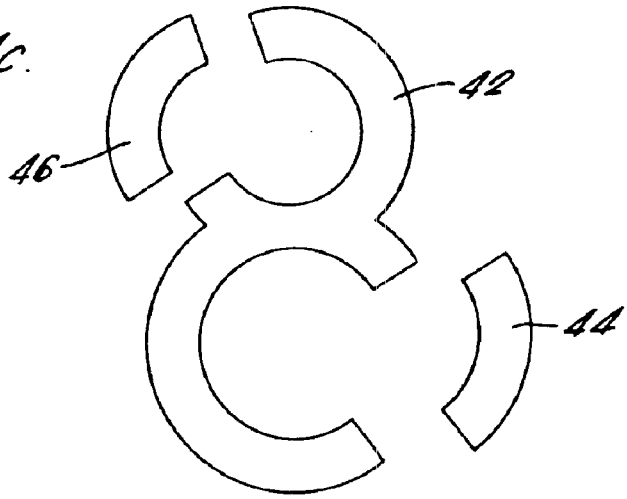

FIG. 4*a* shows a contour grouping made up of three contours, which together define the character "8". FIG. 4*b* shows the character of FIG. 4*a* with several cut lines (40) applied. FIG. 4*c* shows the result of applying the cut lines to the character of FIG. 4*a*—the result is three new contour groupings (42, 44, 46) each of which comprises contours around a fillable area of the original contour grouping that the cut lines of FIG. 4*b* split up.

To decide where cut lines (40) should be placed, the process searches for features in contour groupings that indicate a need for simplification. Two features in particular are used—wide corners and skeleton nodes, which will now be discussed.

Wide Corner Cut Lines

Figure 5:
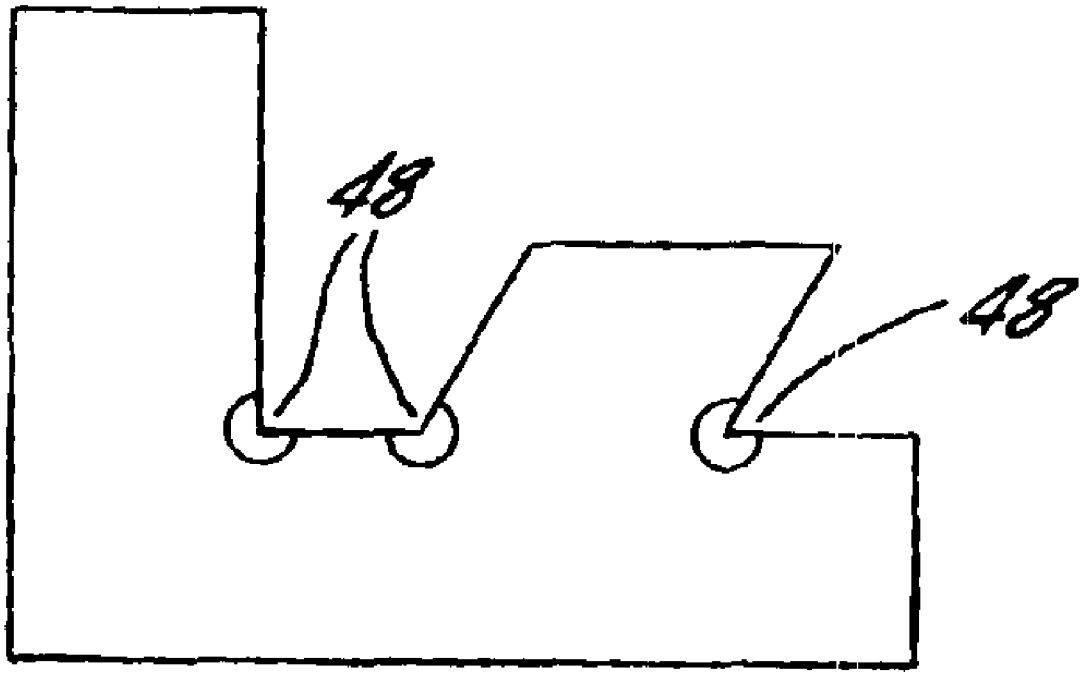
FIG. 5 illustrates wide angled corners, or "wide corners", of a contour grouping.

A change in direction of a contour having certain predefined characteristics, discussed below, is referred to as a wide angled corner. Wide angled corners, illustrated at 48 in FIG. 5, are regarded as features in a contour of a contour grouping that need to be simplified. For each wide corner the simplification process attempts to find a good cut line by using three methods in sequence. The first method seeks cut lines between pairs of wide corners, the second between pairs of a wide corner and a utility corner and the third between pairs of a wide corner and a test point.

Figure 6A:
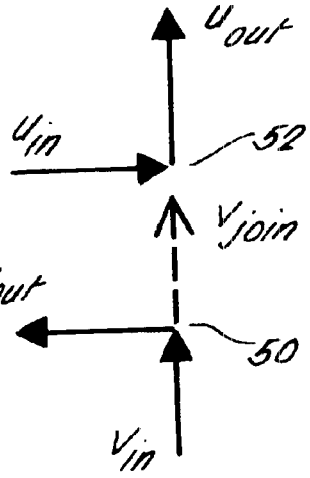
FIG. 6*a* illustrates the construction of a "wide corner—wide corner" cut line.

"wide corner - wide corner" cut lines are constructed by joining a first wide corner 50 to other wide corners. The vectors used in this calculation are illustrated in FIG. 6*a*. All possible wide corner B wide corner cut lines are considered, and the cut line with the highest positive valued measure_1 is used if this measure is greater than 0.9. Each measure_1 is calculated as follows, with reference to a first wide corner 50 (corner_1), and a second wide corner 52 (corner_2).

$v_{Join}$=vector from corner_1→corner_2

$v_{In}$=vector into corner_1

$u_{In}$=vector into corner_2

$v_{Out}$=vector out of corner_1

$u_{Out}$=vector out of corner_2

$$\text{angleCompare}\mathbf{0}=(v_{In}\cdot v_{Join})/(|v_{In}|\cdot|v_{Join}|)$$

$$\text{angleCompare}\mathbf{1}=-(v_{Out}\cdot v_{Join})/(|v_{Out}|\cdot|v_{Join}|)$$

$$\text{angleCompare}\mathbf{2}=-(u_{In}\cdot v_{Join})/(|u_{In}|\cdot|v_{Join}|)$$

$$\text{angleCompare}\mathbf{3}=(u_{Out}\cdot v_{Join})/(|u_{Out}|\cdot|v_{Join}|)$$

$$\text{measure_}\mathbf{1}=\max(\text{angleCompare}\mathbf{0},\ \text{angleCompare}\mathbf{1})*\max(\text{angleCompare}\mathbf{2},\ \text{angleCompare}\mathbf{3})$$

Figure 6B:
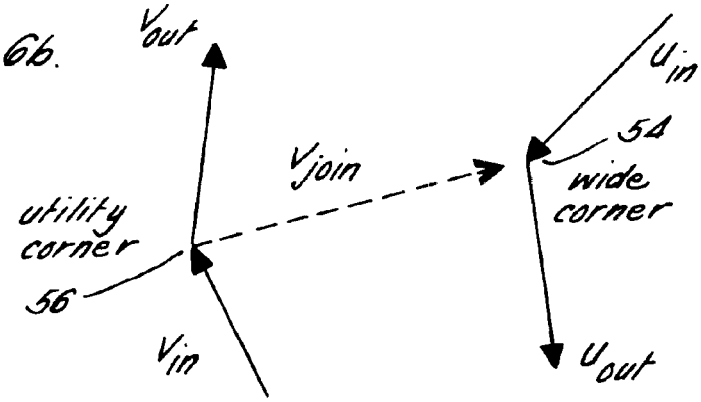
FIG. 6*b* illustrates the construction of a "wide corner—utility corner" cut line.

"Wide corner - utility corner" cut lines are constructed by joining a wide corner 54 to a utility corner 56. The vectors used in this calculation are illustrated in FIG. 6*b*. All possible wide corner B utility corner cut lines are considered, and the cut line with the highest positive valued measure_2 is used if this measure_2 is greater than 0.98. Each measure_2 is calculated as follows:

$v_{Join}$=vector from utility corner→wideCorner $v_{In}$=vector into utility corner $u_{In}$=vector into wideCorner $v_{Out}$=vector out of utility corner $u_{Out}$=vector out of wideCorner $$\text{parallelity}=\max(-(v_{In}\cdot u_{Out})/(|v_{In}|\cdot|u_{Out}|),-(u_{In}\cdot v_{Out})/(|u_{In}|\cdot|v_{Out}|))$$

$$dm\mathbf{0}=(v_{Join}\cdot v_{In})/(|v_{Join}|\cdot|v_{In}|)$$

$$dm\mathbf{1}=-(v_{Join}\cdot v_{Out})/(|v_{Join}|\cdot|v_{Out}|)$$

$$dm\mathbf{2}=-(v_{Join}\cdot u_{In})/(|v_{Join}|\cdot|u_{In}|)$$

$$dm\mathbf{3}=(v_{Join}\cdot u_{Out})/(|v_{Join}|\cdot|u_{Out}|)$$

$$\text{continuation}=\max(|dm\mathbf{0}|,|dm\mathbf{1}|,|dm\mathbf{2}|,|dm\mathbf{3}|)$$

$$\text{measure_}\mathbf{2}=\text{parallelity}*\text{continuation}$$

Figure 6C:
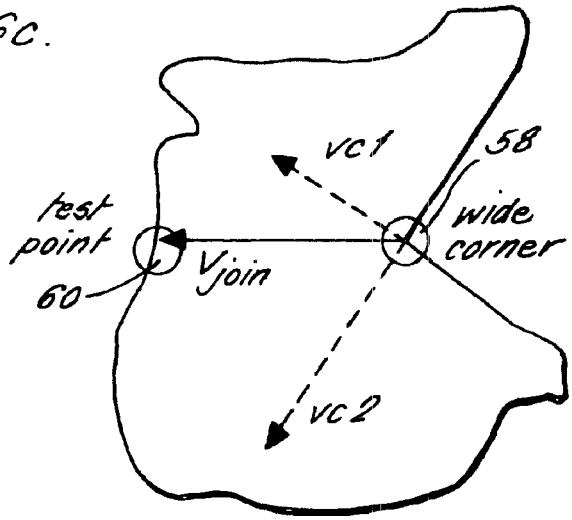
FIG. 6*c* illustrates the construction of a "wide corner—test point" cut line.

"Wide corner - test point" cut lines are constructed by joining the current wide corner 58 to various evenly-distributed test points 60 along the contours of the contour grouping. Two measures, "direction" and "dist", are used to evaluate what constitutes a good contour grouping, as illustrated in FIG. 6*c*.

vc1=vector into wide corner vc2=−vector out of wide corner $v_{join}$=vector from wide corner→test point $$\text{direction}=\max(|(vc\mathbf{1}\cdot v_{Join})/(|vc\mathbf{1}|\cdot|v_{Join}|)|,|(vc\mathbf{2}\cdot v_{Join})/(|vc\mathbf{2}|\cdot|v_{Join}|)|)$$

dist=distance between wide corner and test point

A cut line here is considered to be good if "direction" is greater than 0.7. The process chooses the good cut line with the smallest value of "dist".

Skeleton Node Cut Lines

Each contour grouping is used to generate a corresponding filled region bitmap, which is then thinned using Rosenfeld=s parallel thinning algorithm to form a skeleton. The nodes in this skeleton are analysed to seek appropriate cut lines. The skeleton nodes indicate areas in the contour grouping that can be further simplified.

First, some of the skeleton nodes are removed because they are considered to be inappropriate for use in the method of simplification. A node is discarded if either one of the paths extending from the node is very short, or if the two shorter paths extending from the node are significantly shorter than the longest path extending from the node, and the angle formed at the node point by a triangle made of the node point, the point at the end of the shortest path and the point at the end of the second shortest path is less than 125 degrees.

A cut line is obtained from each remaining node by the following steps:

(1) Move a short distance along the longest skeleton path attached to the node and away from the node, to point p.

(2) Extend a line from p in a direction that is perpendicular to the direction of the skeleton path at point p. Extend a second line from p, but this time in the opposite direction to the first line.

(3) Form a cut line using one point from each of the extended lines, where each line first crosses the contour grouping.

Further Filtering of Cut Lines

The cut lines found from wide corners and the cut lines found from skeleton nodes are filtered by removing cut lines which are long, relative to the average width of the contour grouping, and to ensure no cut lines cross each other.

Method of Repeated Simplification

New contour groupings are generated by dividing existing contour groupings along the cut lines determined using the above methods. This simplification process described above is applied iteratively until a desired level of simplification has been achieved. An initial contour grouping is processed to derive a set of cut lines to divide the grouping into a plurality of simpler contour groupings, each of which is further processed to derive further sets of cut lines to produce yet simpler contour groupings, and so on.

The process proceeds no further with any contour grouping for which no cut lines are derived by the above process, and is preferably terminated after a given number of levels of simplification, whether or not further simplification is possible.

Generation of Stitch Object Files

Figure 7A:
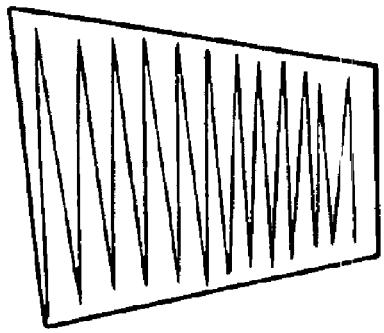
FIGS. 7*a,* 7*b* and 7*c* illustrate embroidery objects to be stitched out with a straight satin column, a curved satin column and a running stitch respectively.
Figure 7B:
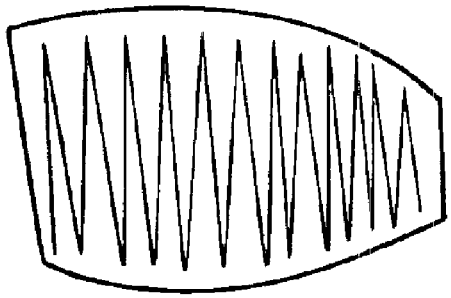
Figure 7C:
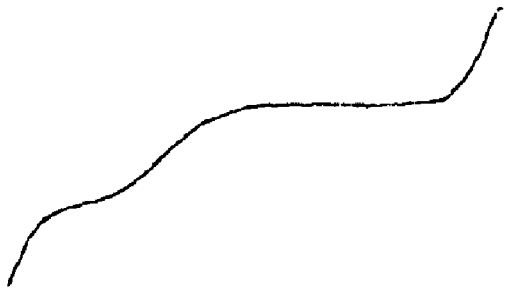

The next stage of the process is to convert the simplified contour groupings into a series of embroidery objects that will subsequently be used to create embroidery stitch data. Primarily, three types of embroidery object are created—straight satin columns, curved satin columns and running stitches. Examples of these types of object are illustrated in FIGS. 7*a*, 7*b* and 7*c* respectively.

Determining Order of Traversal

For each collection of contour groupings, the process must determine in which order to traverse the contour groupings to set out the embroidery objects in a suitable order for subsequent stitching out.

Information is obtained about the connectivity of each contour grouping. This is done by testing each possible pair of contour groupings, and scanning within each pair for one or more common points. FIG. 4*c* illustrates a collection of contour groupings after simplification. It will be seen that the both area 46 and area 44 were originally connected to area 42 in the original contour grouping shown in FIG. 4*a,* so the connectivity information gained in this example is that area 42 is connected to area 46, and area 42 is connected to area 44.

Arbitrary start and end contour groupings are chosen. A route-finding algorithm is then used to determine in which order to traverse the contour groupings while satisfying the connectivity requirements, in order to visit every contour grouping. The route finding algorithm returns a route having no more than a predefined maximum number of steps, or no route if such a route cannot be found.

A summary of the route finding algorithm is given below:

(1) Set a first route position equal to the start contour grouping.

(2) Evaluate contour groupings still to visit.

(3) If there are no contour groupings still to visit then a. If the last point on the route is not equal to the end contour grouping, then traverse to the end contour grouping.

b. If the number of steps in the route is less than or equal to the predefined maximum number of steps, then a valid route has been found, and the algorithm terminates. Otherwise, the algorithm returns to part of the route where a choice was made of what route to take, and chooses an alternative route to take a branch not yet tried, repeating steps 2 and 3 as appropriate.

(4) If there are 1 or more contour groupings still to visit, the algorithm traverses to one of the contour groupings, then returns to stage 2 of algorithm.

In order to find an optimal route which traverses minimum number of contour groupings to get from start to end, the following steps are used to repeatedly try to improve on the most recent route found:

(1) Find a route from start to end, with no limit on the maximum number of steps in route. This is denoted as the best route.

(2) Try to find a route from start to end, with the maximum number of steps allowed equal to the number of steps in the best route minus 1.

(3) If an improved route in stage 2 has been found, set the best route equal to the improved route. Repeat stage 2.

(4) Use the best route.

Creating Embroidery Objects

Once the order to traverse the contour groupings has been determined, the contour groupings are traversed in the order determined to build an ordered list of embroidery objects as follows:

(1) Start at the first contour grouping in the traversal order (2) If the current contour grouping is (a) the last occurrence of the contour grouping in the traversal order, then fill contour grouping with curved satin column and straight satin columns as appropriate. The skeleton determined earlier is used here to ensure that objects are created with the direction of satin stitch approximately perpendicular to the direction of the skeleton through which the stitch would pass.

(b) not the last occurrence of the contour grouping in the traversal order, then use a running line object to move to the next contour grouping in the traversal order. The skeleton line of the current contour grouping is used to define the points that make up the running line object.

(3) Continue with step 2 until there are no more contour groupings left in the traversal order.

After the above process has been completed, an optimization is performed on the satin objects produced in which two adjacent satin objects of the same type, for example both straight satin column or both curved satin column, are combined to produce a single satin object when the connection between the satin objects is smooth, and the new combined satin object is of a similar shape to the previous two satin objects. The process of combining adjacent satin object is repeated until there are no adjacent satin objects that are suitable for such combination.

Figure 8A:
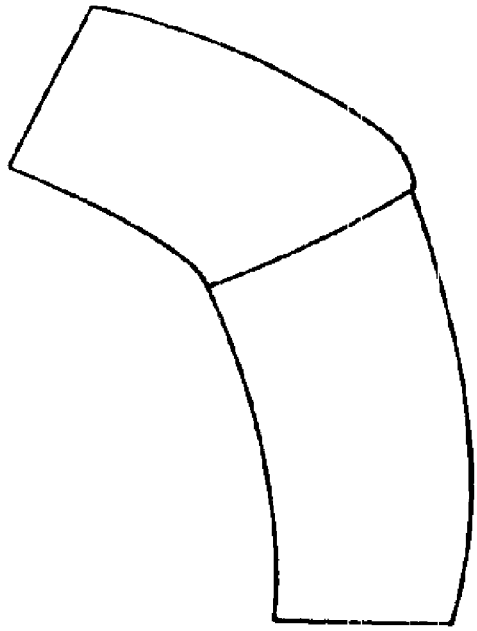
FIG. 8*a* illustrates two satin column objects joined in FIG. 8*b* to produce a single satin column as part of an optimization process.
Figure 8B:
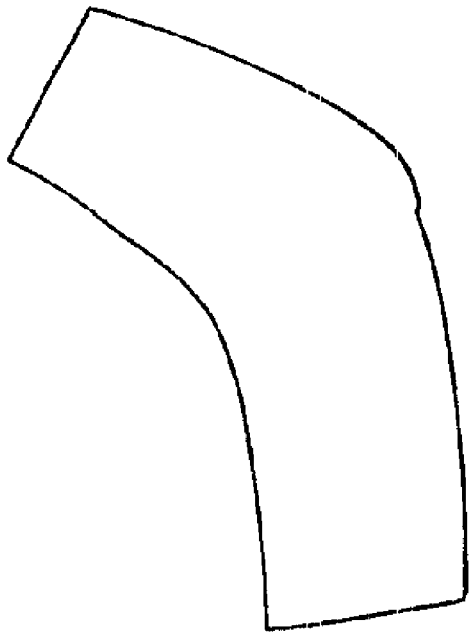

FIGS. 8*a* and 8*b* illustrate the above optimisation. The two adjacent curved satin columns of FIG. 8*a* can be combined to produce one satin column, shown in FIG. 8*b,* while still retaining approximately the same shape of the original curved satin columns.

Final Processing

A list of embroidery objects will now exist, corresponding to each collection of simplified contour groupings. At this stage, jump stitch embroidery objects are added or inserted into the list to place stitches between adjacent embroidery objects that would otherwise not be connected.

Optionally the embroidery objects are now converted into stitch data. The font is then saved either as stitch data or as embroidery objects, character by character either to disk or directly into the memory of an embroidery machine, where each character can be freely utilised and manipulated.

Apparatus

Figure 9:
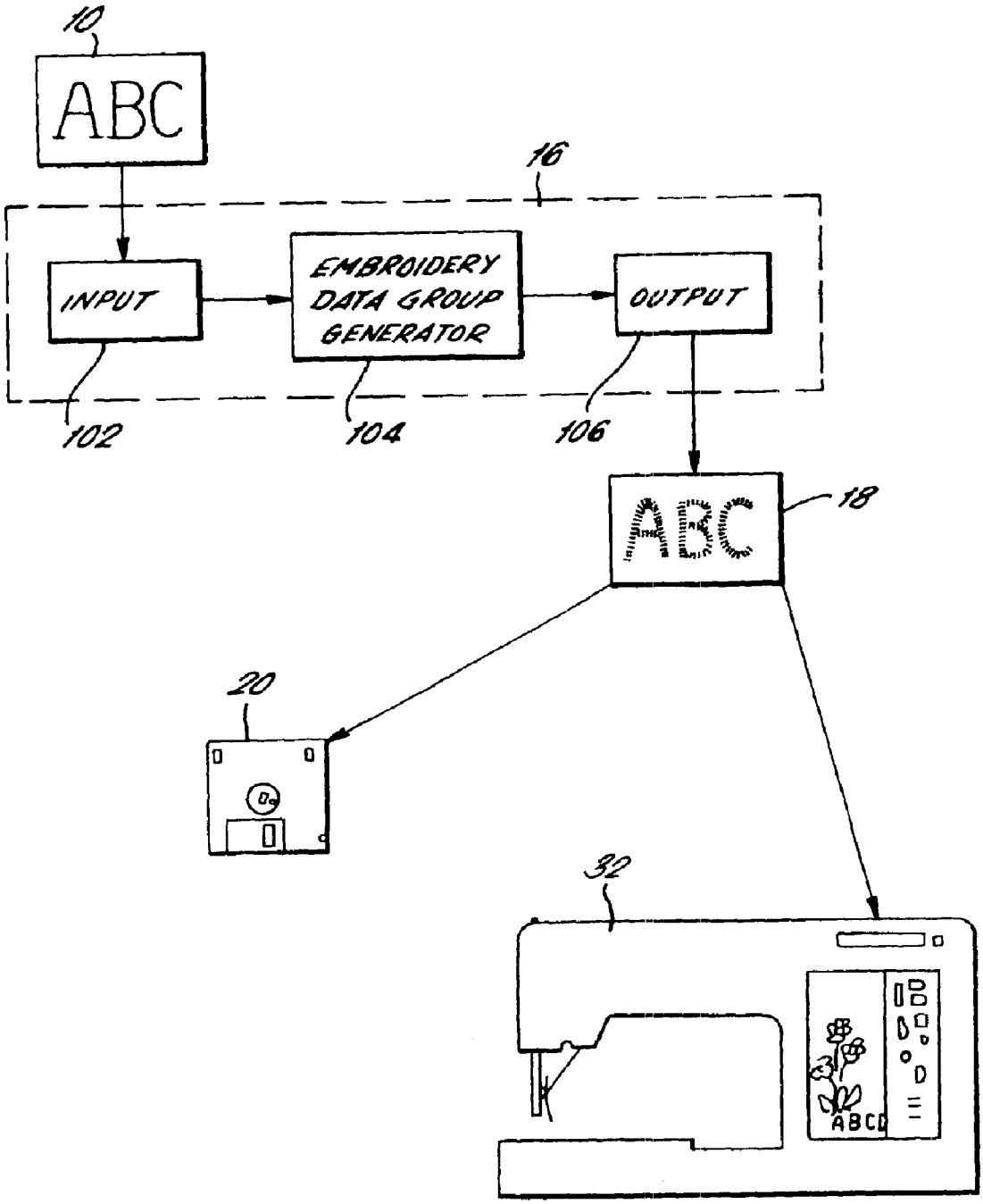
FIG. 9 illustrates apparatus elements for carrying out the invention.

Elements of an apparatus, such as a suitably programmed personal computer, for carrying out steps of the methods set out above will now be briefly described with reference to FIGS. 9 and 10. FIG. 9 is similar to FIG. 1, but the process element 16 is shown as including an input element 102, a generator element 104 and an output element 106. The input element 102 is adapted to input font character data defining the characters of a predetermined font, such as a TrueType or other scalable font, preferably defining the outlines of the font characters.

The generator element 104 is for generating, in a predetermined embroidery data format, a respective embroidery data group from the font character data of each respective font character. The output element 106 is for providing output of the generated data groups in such a way that each data group is individually selectable by an embroidery machine for inclusion in an embroidery design. The output element 106 may write the data groups to machine readable media 20, or directly to an embroidery machine 32.

Figure 10:
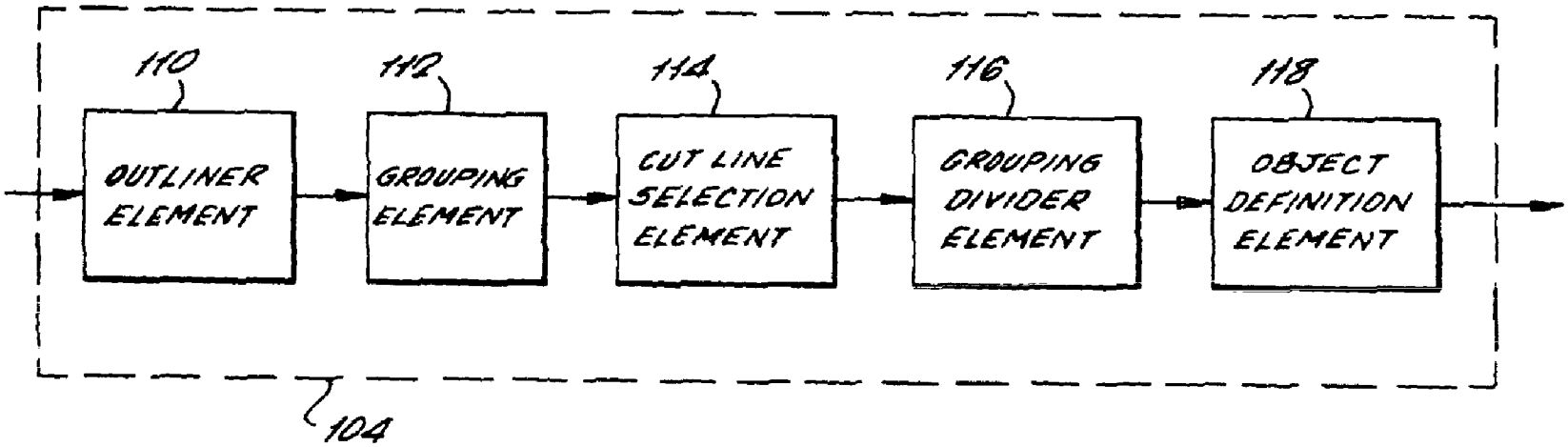
FIG. 10 shows in more detail the generator element of FIG. 9.

FIG. 10 illustrates elements of the embroidery data group generator 104. Input font character data is processed, sequentially, by an outliner element 110, a grouping element 112, a cut line selection element 114, a groupings divider element 116 and an object definition element 118. The outliner element 110 analyses the font character data to identify one or more outline contours of each character. The grouping element 112 associates outline contours into one or more contour groupings, where each grouping defines the outline of at least a part of a font character. The cut line selector element 114 selects or generates one or more cut lines across contour groupings, and the divider element 116 divides the contour groupings along the cut lines to yield a larger number of contour groupings. Finally, an object definition element 118 uses the contour groupings to define a plurality of embroidery objects.

What is claimed is:

1. A method of operating a computer system to provide character data for use by an embroidery machine, comprising the steps of:

inputting font character data defining the characters of a predetermined font;

generating, in a predetermined embroidery data format, a respective embroidery data group from the font character data of each respective font character through steps comprising:

analysing the font character data to identify one or more outline contours of the corresponding font character;

associating the contours into one or more contour groupings, each contour grouping defining the outline of at least a part of the corresponding font character;

constructing one or more cut lines across one or more of the contour groupings;

dividing the contour groupings along the cut lines to yield a larger number of contour groupings;

and defining a plurality of embroidery objects, each embroidery object being derived from a respective one of said larger number of contour groupings; and outputting said embroidery data groups in such a way that each embroidery data group is individually selectable by an embroidery machine for inclusion in an embroidery design.

2. The method of claim 1 wherein said step of generating respective embroidery data groups comprises the step of generating a respective embroidery object group from the font character data of each respective font character, each object group comprising one or more embroidery objects, and wherein said output embroidery data groups comprise said embroidery object groups.

3. The method of claim 1 wherein said step of generating respective embroidery data groups comprises the steps of:

generating a respective embroidery object group from the font character data of each respective font character, each object group comprising one or more embroidery objects; and converting said respective embroidery object groups to a corresponding respective stitch instruction groups, and wherein said output embroidery data groups comprise said stitch instruction groups.

4. The method of claim 3 further comprising a step of scaling the objects of said respective embroidery object groups prior to, or during said step of converting.

5. The method of claim 1 wherein said predetermined font is a scalable font.

6. The method of claim 1 wherein said predetermined font defines the outlines of said characters.

7. The method of claim 1 wherein the font is a vectorized font.

8. The method of claim 1 wherein substantially all of the characters of said predetermined font are output as said embroidery data groups in the step of outputting.

9. The method of claim 1 wherein the step of generating said embroidery data groups from said font character data is carried out automatically.

10. The method of claim 1 wherein the step of selecting one or more cut lines comprises the steps of:

identifying changes of direction of the outline contours, the changes of direction having predetermined characteristics; and constructing one or more cut lines proximate to the identified changes of direction.

11. The method of claim 1 wherein the step of constructing the one or more cut lines comprises the steps of:

generating a skeleton corresponding to the font character;

identifying one or more nodes of the skeleton; and constructing one or more cut lines proximate to the identified nodes.

12. The method of claim 1 wherein the step of outputting comprises the step of writing said embroidery data groups onto one or more removable machine readable media.

13. The method of claim 12 wherein said removable machine readable media are selected from the list comprising floppy disks, CDROMS and removable solid state memory devices.

14. The method of claim 1 wherein the step of outputting comprises the step of transmitting said embroidery data groups to an embroidery machine.

15. The method of claim 1 further comprising the steps of:

inputting, into an embroidery machine, embroidery data groups corresponding to one or more of said characters; and incorporating, in said embroidery machine, said input embroidery data groups into an embroidery design.

16. The method of claim 15 further comprising the step of storing said embroidery design in a memory of said embroidery machine.

17. The method of claim 15 further comprising the step of operating the embroidery machine to stitch out at least a part of said embroidery design.

18. A method of operating a computer to produce an embroidery data group comprising an object-based description of a font character, from font character data describing the font character, the method comprising the steps of:

analysing the font character data to identify one or more outline contours of the font character;

associating the outline contours into one or more contour groupings, each contour grouping defining the outline of at least a part of the font character;

selecting one or more cut lines across one or more of the contour groupings;

dividing the contour groupings along the cut lines to yield a larger number of contour groupings; and defining a plurality of embroidery objects, each embroidery object being derived from a respective one of said larger number of contour groupings.

19. The method of claim 18 wherein the step of selecting one or more cut lines comprises the steps of:

identifying one or more changes of direction of the outline contours, the changes of direction having predetermined characteristics; and selecting one or more cut lines so as to be adjacent to or to pass through the identified changes of direction.

20. The method of claim 18 wherein the step of selecting one or more cut lines comprises the steps of:

generating a skeleton corresponding to the font character;

identifying one or more nodes of the skeleton; and selecting one or more cut lines so as to be adjacent to or to pass through the identified nodes.

21. The method of claim 18 wherein the step of dividing is carried out iteratively, such that a smaller contour grouping produced by dividing a larger contour grouping is itself divided by the subsequent selection of one or more cut lines by analysis of the smaller contour grouping.

22. Computer apparatus for producing an embroidery data group comprising an object-based description of a font character, from font character data describing the font character, the apparatus comprising:

an outliner element for analysing the font character data to identify one or more outline contours of the font character;

a grouping element for associating the outline contours into one or more contour groupings, each contour grouping defining the outline of at least a part of the font character;

a outline selection element for selecting one or more cut lines across one or more of the contour groupings;

a divider element for dividing the contour groupings along the cut lines to yield a larger number of contour groupings; and an object definition element for defining a plurality of embroidery objects, each embroidery object being derived from a respective one of said larger number of contour groupings.

23. A computer readable medium comprising computer program code for operating a computer to produce an embroidery data group comprising an object-based description of a font character, from font character data describing the font character, the computer program code being adapted for:

analysing the font character data to identify one or more outline contours of the font character;

associating the outline contours into one or more contour groupings, each contour grouping defining the outline of at least a part of the font character;

selecting one or more cut lines across one or more of the contour groupings;

dividing the contour groupings along the cut lines to yield a larger number of contour groupings; and defining a plurality of embroidery objects, each embroidery object being derived from a respective one of said larger number of contour groupings.

24. A removable machine readable medium comprising a plurality of embroidery data groups generated by a computer system and output to the medium by a method comprising the steps of claim 1.

25. A removable machine readable medium comprising a plurality of embroidery data groups generated by a computer system and output to the medium by a method comprising the steps of claim 18.

* * * * *